United States Patent [19]

Komuro et al.

[11] 4,319,665

[45] Mar. 16, 1982

[54] AC ELEVATOR CONTROL SYSTEM

[75] Inventors: Katsu Komuro, Mito; Sadao Hokari; Yasuyuki Maeda, both of Katsuta, all of Japan

[73] Assignee: Hitachi, Ltd., Tokyo, Japan

[21] Appl. No.: 147,046

[22] Filed: May 6, 1980

[30] Foreign Application Priority Data

May 11, 1979 [JP] Japan ..... 54-57067

[51] Int. Cl.[3] ..... B66B 1/28

[52] U.S. Cl. ..... 187/29 R

[58] Field of Search ..... 187/29

[56] References Cited

U.S. PATENT DOCUMENTS 3,918,552 11/1975 Kameyama et al. ..... 187/29
4,150,734 4/1979 Ohira et al. ..... 187/29
4,213,517 7/1980 Ando ..... 187/29

FOREIGN PATENT DOCUMENTS 1526369 9/1978 United Kingdom ..... 187/29

*Primary Examiner*—J. V. Truhe
*Assistant Examiner*—W. E. Duncanson, Jr.
*Attorney, Agent, or Firm*—Craig and Antonelli

[57] ABSTRACT

A control system for an AC elevator system in which an actual speed of an elevator car is compared with a speed command and control is made so that deviation between the actual speed and the commanded speed becomes zero. The speed command is so composed that deceleration of the elevator car is gradually decreased as the car approaches to a target landing position in the stopping operation of the elevator. A motoring torque or a braking torque is additionally generated in dependence on a load on the car in a region close to the target landing position.

14 Claims, 10 Drawing Figures

AC ELEVATOR CONTROL SYSTEM

The present invention relates to a control system for an AC elevator system. In particular, the invention concerns an improvement in a control system for an AC elevator provided with a speed feedback control loop.

Induction motors are made use of widely in various industrial fields. By virtue of remarkable development of the applied technology of thyristors in recent years, combination of the induction motor and the thyristor circuit is increasingly employed.

For example, in the case of a conventional elevator system, an induction motor is commonly used as a drive source for the elevator. However, in a refined elevator system, a DC motor has often been used, because of capability of a more accurate speed control. At present, it is possible to accomplish a very accurate speed control even by using an induction motor when combined with a thyristor circuit. Under the circumstances, induction motors tend to be increasingly employed in applications where DC motors have been hitherto used.

In this connection, U.S. Pat. No. 3,876,918 filed Aug. 9, 1973 in the name of K. Komuro et al and issued Apr. 8, 1975 discloses a control system for an AC elevator system which comprises an induction motor for driving the elevator, means for producing a speed command for the elevator, means for detecting the actual speed of the elevator, motoring control means for adjusting through a speed feedback path a motoring torque generated in the induction motor in accordance with speed deviations between the command speed and the actual speed when the commanded speed is higher than the actual speed, braking control means for adjusting through the speed feedback path a braking torque generated in the induction motor in accordance with the speed deviations when the actual speed is higher than the commanded speed, and an electromagnetic brake for stopping and holding stationarily the driven system of the elevator when a predetermined position or zero speed of the elevator car is detected.

It has however been found that the aforementioned elevator control system still suffers from such shortcomings as described below.

Generally, an elevator car and a counter weight are suspended over a sheave through a rope in a well-rope-like manner with one end of the rope connected to the elevator car, while the other end is connected to the counter weight. Since the weight of the elevator car varies in dependence on a load within the car, e.g. the number of passengers in the car, the weight of the elevator car inclusive of the load therein will scarcely be balanced with the counter weight, resulting in that an unbalance rotary torque due to the difference in weight between the elevator car and the counter weight acts always on the driven system of the elevator. Of course, the weight of the counter weight is selected heavier than that of the elevator car under no load and lighter than that of the car under the so-called full load. Consequently, in the starting operation of the elevator for example, the car will run out in the direction determined by the unbalance rotary torque depending on the load state in the car since the motoring torque control is not effected properly until the speed deviation has attained a predetermined value. Another disadvantage is also involved in the stopping operation of the elevator car. More specifically, although the speed control is made such that the deceleration of the elevator car is gradually decreased as the car approaches to a desired landing point or floor so as to reduce the deceleration of the car substantially to zero at the landing floor, it often occurs that the speed of the car can not be brought to zero at the landing floor and the car is forcively stopped by means of the electromagnetic brake so as to cause the speed to be zero resulting in a vibration of the car to thereby degrade the comfortable ride of the passengers, as will be discussed in more detail in conjunction with preferred embodiments of the invention. The occurrence of such a vibration of the elevator car can be explained by the fact that the elevator car is suspended from the sheave through the flexible rope on one hand, while, the torque to be controlled is applied to the suspending sheave.

An object of the invention is to provide an AC elevator control system which is evaded from the drawbacks of the prior art described above and which can assure an improved comfortable ride in the starting and stopping operations of the elevator car as well as an enhanced landing accuracy of the elevator car.

According to a general feature of the invention, additional torque generating means is provided for generating additionally a torque in the induction motor in a region in the vicinity of the landing point where deceleration of the car commanded by the speed command signal is caused to be gradually decreased.

The above and other objects, features and advantages of the invention will become more apparent from the following description taken in conjunction with the accompanying drawings, wherein:

FIG. 1 is a block diagram showing a general arrangement of an AC elevator control system according to an embodiment of the invention;

FIGS. 2*a* thru 2*f* are waveform diagrams to illustrate operations of an elevator system when a load compensation is made only in the starting operation of the car under a heavy load;

FIGS. 3*a* thru 3*f* are diagrams similar to FIGS. 2*a* thru 2*f* and illustrate operation of the elevator system when a load compensation is made only in the starting operation of the car which is under a light load;

FIGS. 4*a* thru 4*f* illustrate graphically operations of the elevator system when the load compensation is made in both the starting and the stopping operations for the car which is under the light load;

FIGS. 5*a* thru 5*f* illustrate graphically operations of the elevator system when the load compensation is made in both the starting and the stopping operations for the elevator car which is under the heavy load;

Figure 1:
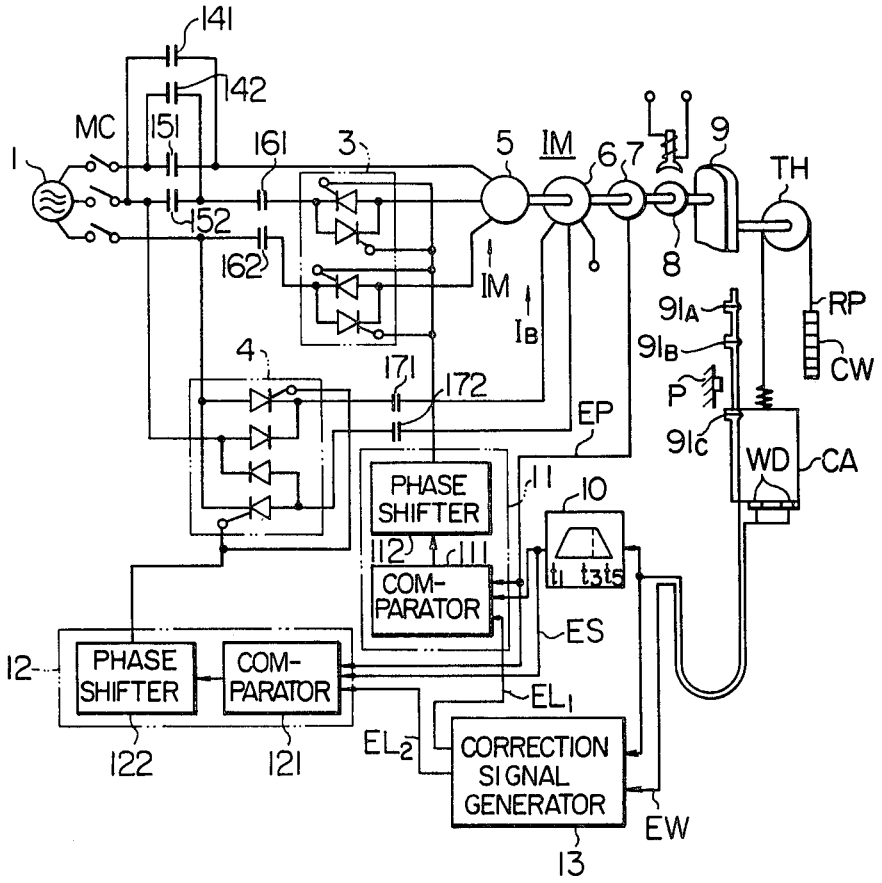

Now, description will be made of an AC elevator control system according to a preferred embodiment of the invention by referring to FIG. 1. In this figure, reference numeral 1 denotes a three-phase AC power supply source which feeds electric power to a motoring torque generating winding 5 of a three-phase induction motor IM constituting a driving source for an elevator cage or car CA through a main contactor MC, up-contactors 141 and 142 adapted to be closed only when the elevator car CA is to be moved in the upward direction, down-contactors 151 and 152 adapted to be closed only when the elevator car CA is to be moved in the downward direction, contactors 161 and 162 for energizing the motoring torque generating winding 5 and a voltage regulator circuit 3 which is consituted by a predetermined number of antiparallel connections of paired thyristors. On the other hand, a winding 6 of the induction motor IM for generating a braking torque is supplied with a DC braking current $I_B$ from the three-phase AC power source 1 through the main contactor MC, a controlled rectifier circuit 4 and contactors 171 and 172 for energizing the braking torque generating winding 6. The three-phase induction motor IM has an output shaft to which a tachometer generator 7, an electromagnetic brake system 8, a reduction gear train 9 and a sheave TH are coupled. A rope RP is suspended around the sheave TH in a well-rope-like manner and has one end connected to the elevator car CA and the other end connected to a counter weight CW.

Next, a speed feedback control system will be described. Reference numeral 10 in FIG. 1 designates speed command generating means which is adapted to generate a speed command signal which rises linearly as a function of time in an accerelation mode for starting the elevator operation on one hand and sinks as a function of a distance to a destined stop point in a deceleration mode for stopping the elevator car CA at the desired destination on the other hand. In order to generate such speed command signal, positional information of the elevator car CA is required. To this end, there are provided stationarily in the elevator shaft along the path of the elevator car CA a predetermined number of magnetic path interrupting plate members P each of which is associated with each of the stop points and adapted to cooperate with a group of reed switches 91A, 91B and 91C which in turn are mounted on the elevator car CA so as to be actuated when positioned in opposition to the magnetic path interrupting plate member P, as is schematically illustrated in FIG. 1. More specifically, the point at which the deceleration of the elevator car CA is to be triggered may be detected through actuation of the reed switch 91A and thereafter positional information of the elevator car CA is successively obtained through successive operations of the other reed switches 91B and 91C. The positional information thus obtained is utilized by the speed command generating means 10 for producing the speed command for decelerating the elevator cage CA. However, it is difficult in practice to detect the deceleration initiating point only by means of the switch mounted on the elevator car CA. Accordingly, in a practical application, the positional signal may be supplied from a floor controller hitherto known by itself (not shown) in a relatively high speed range of the elevator car CA, while the positional information signals produced from the switches mounted on the elevator car may be utilized for generating the deceleration command signal in a relatively low speed range of the elevator car CA (i.e. in a distance range close to the destined stop point). Alternatively, it is also possible to obtain the positional information of the elevator car by counting pulses produced in dependence on the travelling of the elevator car in a known manner.

Here, it should be mentioned that the motoring torque generating winding 5 and the braking torque generating winding 6 may be replaced by a combination of separate induction motors having a small number of poles and a large number of poles, respectively, with output shafts thereof being mechanically coupled to each other.

A speed command or control signal ES output from the speed command generating means is applied to one input of a comparator 111 provided in a controller 11. An output signal EP produced from the tachometer generator 7 is applied to another input of the comparator 111 in a differential manner relative to the speed command signal ES. Unless a compensation signal $EL_1$ applied to a third input of the comparator 111 as will be described hereinafter is taken into consideration, the comparator 111 produces an output signal when $EP<ES$, which output signal is in proportion to a speed deviation represented by $(ES-EP)$ and applied to a phase shifter 112. Through phase control of the thyristors of the voltage regulator circuit 3 by the phase shifter 112 in dependence on the speed deviation signal in a well known manner, a current $I_M$ corresponding to the speed deviation $(ES-EP)$ is allowed to flow through the motoring torque generating winding 5 of the induction motor IM, whereby a torque which causes the actual speed of the elevator car to follow up the speed commanded in the motoring mode is produced by the motoring torque generating winding 5, when the actual speed of the elevator car CA is lower than the commanded speed. In this way, it can be said that the voltage regulator circuit 3 and the controller 11 constitute a motoring control means.

On the other hand, the output signal EP from the tachometer generator 7 is applied to an input of a comparator 121 provided in a controller 12 and the speed command signal ES output from the speed command generating means 10 is applied to another input of the comparator 121 in a differential manner relative to the actual speed signal RP. Unless the compensating signal $EL_2$ applied to a third input of the comparator 121 is taken into consideration, the comparator 121 produces an output signal when $EP>ES$, which signal is in proportion to a speed deviation $(EP-ES)$ and applied to a phase shifter 122. Through the phase control of the thyristors of the controlled rectifier circuit 4 by the phase shifter 122 in a well known manner, a DC braking current $I_B$ corresponding to the speed deviation $(EP-ES)$ is allowed to flow through the braking torque generator winding 6 of the induction motor IM when the actual speed of the elevator car CA is higher than the commanded speed, whereby a braking torque is generated and causes the actual speed of the elevator car to follow the commanded speed. It can thus be said that the controlled rectifier circuit 4 and the controller 12 constitute a brake control means.

By virtue of the motoring control and the braking control through the speed feedback control system described above, the speed of the elevator car CA can be controlled so as to follow up the commanded speed over the whole speed range including acceleration for starting and deceleration for stopping the car CA.

Figure 2:
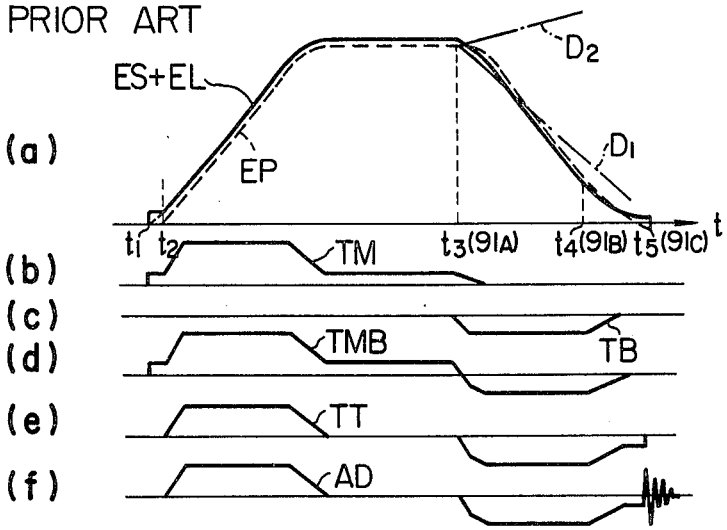
FIG. 2 PRIOR ART

Now considering the elevator operating system, there is acting on the elevator car CA a torque which is ascribable to a difference in weight between the elevator car CA and the counter weight CW, as briefed hereinbefore. More particularly, referring to FIG. 2, it is assumed that the elevator car CA is rendered to coast or run freely at a deceleration initiating time point $t_3$. Further, the counter weight is assumed to be so selected that the elevator car can be decelerated in the coasting along a straight line segment $D_1$ under a heavy load, i.e. in the case of upward movement under the full load and downward movement under no load, while acceleration of the elevator car can take place in the coasting along a straight line segment $D_2$ when the car is under a light load, i.e. in the case of the upward movement under no load and the downward movement under the full load. Accordingly, except for the load conditions described just above, the elevator car tends to be accelerated or decelerated in a speed range delimitted between the lines $D_2$ and $D_1$ in dependence on the load actually applied to the elevator car. Such performance of the elevator car will be hereinafter referred to as the free-run characteristics. Although FIG. 2 illustrates the free-run characteristics in the coasting upon deceleration of the elevator car at the time point $t_3$, the free-run characteristic described above applies valid for the operations at any other time points. For example, it will be readily understood that the elevator car will be subjected to the coasting in accordance with the free-run characteristic, if the electromagnetic brake is released without the motoring torque or the braking torque being produced at the starting of the elevator car. In other words, when the electromagnetic brake 8 is released or removed before the speed deviation described hereinbefore has been established, a phenomenon will occur in which the elevator car is caused to move in the direction designated by the rotary torque produced due to the prevailing unbalanced load state between the elevator car CA and the counter weight CW. In order to prevent such an undesirable phenomenon, a so-called load compensation is effected. To this end, a correction or compensation signal generating means 13 is provided to receive a load signal EW produced from a load detecting means WD disposed at a bottom of the elevator car CA and selectively produce compensation signal $EL_1$ and $EL_2$, in such a manner as described later, corresponding to the load signal EW. The compensation signals $EL_1$ and $EL_2$ thus selectively produced are applied to the comparator 111 and 121 respectively, as the result of which the motoring torque corresponding to the prevailing load on the elevator car is generated in the induction motor IM so that the rotary torque produced due to the unbalanced load state is cancelled by the motoring or braking torque now produced in response to the compensation signal before the electromagnetic brake 8 is released, whereby the driven elevator system is held in the stationary state (i.e. the zero-speed state). Thereafter, when the speed deviation (ES−EP) is established (at a time point $t_2$, for example), the magnitude of the compensation signal $EL_1$ or $EL_2$ is progressively decreased. In this manner, the undesirable spontaneous movement of the elevator car due to the rotary torque produced under the unbalanced load state upon starting of the elevator car can be positively prevented.

Next, description will be made of control operations of the elevator control system of the arrangement described above. Referring to speed pattern diagram (a) illustrated in each of FIGS. 2 to 5, when a start command is issued to the elevator control system at a time point $t_1$, the electromagnetic brake 8 is released and the speed command signal ES begins to be generated. At a time point $t_2$, the speed deviation between the speed command signal ES and the actual speed signal EP derived from the tachometer generator 7 is established. The elevator car or cage CA is started around the time point $t_2$. At the time point $t_3$, the reed switch 91A is actuated and the deceleration of the elevator car is initiated, as described hereinbefore. From a time point $t_4$, the rate at which magnitude of the speed command signal is decreased substantially linearly as a function of time is reduced progressively. At a time point $t_5$, the driven elevator system is stopped and held stationarily. In each of FIGS. 2 to 5, a waveform illustrated at (b) represents a profile of the motoring torque TM, a waveform illustrated at (c) represents a profile of the braking torque TB, a waveform illustrated at (d) represents a profile of the overall torque TMB=(TM+TB), a waveform illustrated at (e) represents a profile of the torque TT applied actually to the elevator car CA, and a waveform AD illustrated at (f) represents the rate of change in speed of the elevator car CA. A positive or upper half of the waveform AD corresponds to acceleration, while the negative or lower half of the waveform AD corresponds to deceleration.

The speed pattern as well as the torque profiles illustrated in FIG. 2 are depicted on the assumption that the elevator car is under a heavy load. It will be seen from the waveforms (b) and (d) shown in FIG. 2 that, in the starting operation, an additional motoring torque is produced in the induction motor IM by a compensation signal such as a signal portion a graphically illustrated in FIG. 6B during a time interval from the time point $t_1$ to $t_2$ until the speed deviation (ES−EP) has been established. Further, it will be readily understood from the waveform (e) that the rotary torque produced due to the unbalanced load state is cancelled out by the additional motoring torque, whereby the running-out of the car CR in the starting operation can be prevented. The compensating signal is progressively reduced after the time point $t_2$. When the elevator car CA is under the heavy load in the starting operation, the acceleration of the car CA is progressively increased, as is illustrated at (f) in FIG. 2, whereby a comfortable ride is assured. More particularly, the portion a of the compensating signal $EL_1$ of FIG. 6B is added to the speed command signal ES to thereby effect such control that the speed deviation ($ES+EL_1-EP$) is reduced to zero. In this connection, it should be mentioned that the load compensation in the elevator starting operation under the heavy load as described above has been hitherto known.

Figure 3:
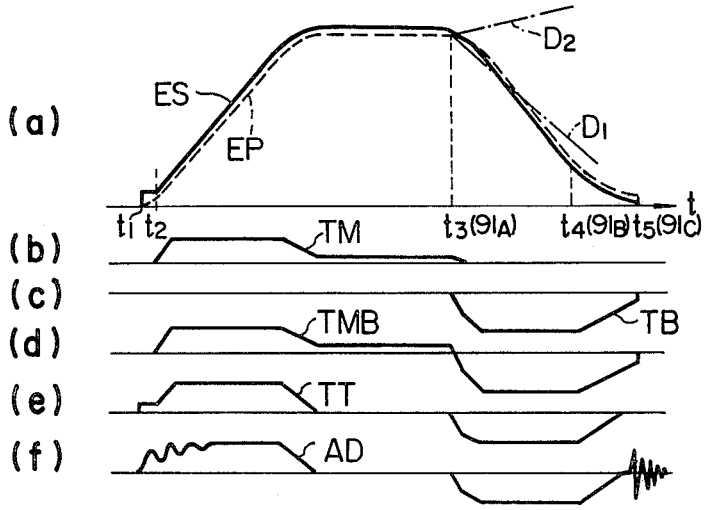

On the other hand, assuming that no load compensation is made for the starting operation of the elevator car which is under a light load, a rotary torque is produced due to the unbalanced load state in the accelerating direction parallel to that of the straight line segment $D_2$ upon releasing of the electromagnetic brake 8 in the starting operation, as the result of which the elevator cage CA is driven abruptly through the action of the torque TT which has certain magnitude as illustrated in FIG. 3 at (e) even when no motoring torque TMB is produced in the induction motor IM, whereby the elevator car CR is subjected to vibration due to the presence of the rope or the like as described hereinbefore. Consequently, the acceleration AD of the elevator car CA is vibrated in such a manner as illustrated at (f) in FIG. 3 in the starting operation under the light load, thereby degrading the comfortable ride. The load compensation is also effective in order to eliminate such a disadvantage. The load compensation in the starting operation of an elevator car which is under a light load is proposed according to the present invention. To this end, the signal portion a of the compensating signal $EL_2$ (FIG. 7B) is effectively applied to the comparator 121 of the controller 12. More particularly, the portion a of the compensating signal $EL_2$ is added to the actual speed signal EP to produce such a braking torque that the speed deviation ($EP+EL_2-ES$) is reduced to zero.

Figure 4:
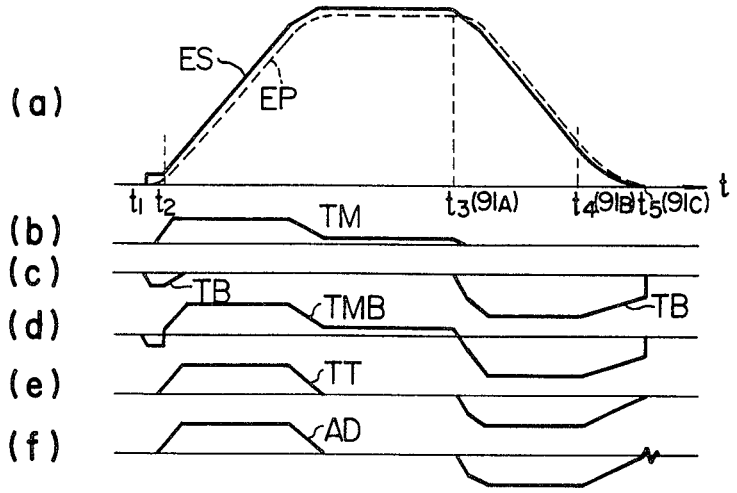
Figure 5:
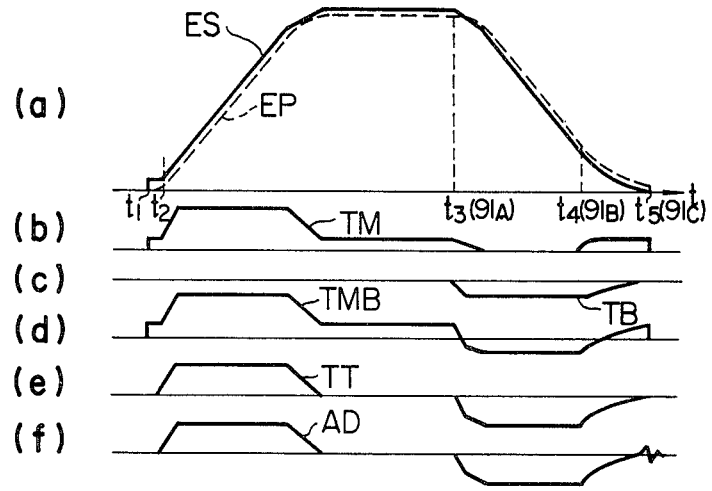

FIG. 4 illustrates the speed pattern of the elevator car (A) as well as the various torques produced in the starting and stopping operations of the elevator car which is under a light load, wherein the load compensation is adopted. As can be seen from the waveform (c) shown in FIG. 4, a DC braking current is caused to flow through the braking torque generating winding 6 in dependence on the portion a of the compensation signal $EL_2$ (FIG. 7B) from the time point $t_1$, to thereby generate an additional braking torque TB' for cancelling out the rotary torque produced due to the unbalanced load state. As the speed of the elevator car is increased in response to the speed command signal, the compensation signal $EL_2$ is progressively lowered starting from the time point $t_2$, to thereby decrease the DC braking current. Since the motoring torque TM on its part is increased progressively as indicated by the waveform (b), the acceleration of the elevator car is smoothly increased without being subject to vibrations as illustrated in FIG. 4 at (f).

Next, description will be made on the operation for stopping the elevator car.

In the first place, stopping operation of the car under a heavy load will be elucidated by referring again to FIG. 2 on the assumption that no load compensation is effected. It is assumed that deceleration is initiated at the time point $t_3$. In this case, the speed of the elevator car which will otherwise tend to be decelerated in accordance with the free-run characteristics along the straight line segment $D_1$ is caused to follow the speed command signal ES by producing the braking torque TB in the induction motor IM through a corresponding DC braking current $I_B$. When the elevator car has attained a position in the vicinity of the destined stop point (at the time point $t_4$) in succession to the actuation of the reed switch 91B, deceleration commanded by the speed command signal ES is progressively decreased so as to attain a smooth landing at the destined floor with deceleration of substantially zero. Consequently, in a region close to the time point $t_5$, the actual speed EP of the elevator car will be decreased with the same slope as that of the straight line segment $D_1$ (i.e. with the constant deceleration), as the result of which it becomes impossible to control deceleration of the elevator car to be gentler than the slope of the straight line segment $D_1$ upon landing of the car on the destined floor. In more detail, as described hereinbefore in conjunction with the starting operation, the motoring torque can not be generated unless the speed deviation ($ES-EP$) has attained a certain magnitude even when the value of the speed deviation ($ES-EP$) is positive. Such tendency becomes more remarkable for the reason described below. For starting the elevator car, it is certainly required that the acceleration should be effected as smoothly as possible. However, severe requirement is not imposed on the accuracy with which the speed of the car is controlled in the course of starting. To the contrary, for decelerating the elevator car, the speed control has to follow up the speed command with a high fidelity, because otherwise the elevator car could not be stopped at the destined floor with a desired accuracy. In order to meet the requirement, the brake control means will have to be imparted with a sufficiently high gain. Of course, the motoring control means should also have a high gain, if possible. However, when both of these control systems have high gains, great difficulty will be encountered in adjustment of these control systems to a disadvantage. Accordingly, it is desirable to give a relatively low gain to the motoring control means, while the gain of the brake control means is selected relatively high. From such a viewpoint, the inertia coefficient ($GD^2$) of the driven system of the elevator should be so selected that the free-run characteristics be established in the range delimitted between the curves $D_1$ and $D_2$ as described hereinbefore, to thereby protect the driven system against possible incontrollability of deceleration.

Another fact to be considered resides in that a friction torque of the driven system of the elevator will be increased rapidly, as the speed of the elevator car approaches to zero. Accordingly, unless a correspondingly increased motoring torque is generated, the speed of the elevator car will drop at a higher rate, rendering it eventually impossible to decrease progressively the deceleration AD of the elevator car in following up the speed command ES. It will thus be appreciated that deceleration AD of the elevator car exhibits still a tendency not to be progressively lowered, even when the gain of the control systems and the inertia coefficient ($GD^2$) are selected so as to meet the requirements described above.

For these reasons, the actual speed EP of the elevator car will be accompanied by deceleration AD of a certain magnitude even at the landing point corresponding to the time point $t_5$ as is indicated by a broken line in FIG. 2. Accordingly, when the speed of the elevator car is reduced to zero by enforcively stopping the driven system of elevator by means of the electromagnetic brake 8 after the moving direction and hence the direction of speed has been changed-over at the landing point $t_5$, as is illustrated in FIG. 2 at (a), the elevator car CA will undergo appreciable vibrations. In other words, deceleration AD of the elevator car CA is subjected to remarkable fluctuations as is illustrated in FIG. 2 at (f), involving degradation in a comfortable ride.

The problems discussed above can be solved through compensation by utilizing the portion b of the compensation signal $EL_1$ (FIG. 6B) which is produced in dependence on the load signal EW from a time point when the elevator car arrives at a position close to the landing point. Now, the control operation for stopping the elevator under a heavy load at a destined floor according to the teaching of the invention will be elucidated by referring to FIG. 5. When the elevator car being decelerated at a substantially constant rate has reached a position (time point $t_4$) at which the reed switch 91B is actuated, magnitude of deceleration as commanded by the speed command signal ES is progressively decreased, as can be seen from the waveform (a) shown in FIG. 5. At the same time, the motoring torque TM begins to be gradually generated in dependence on the portion b of the compensation signal $EL_1$ (FIG. 6B) to a maximum level which is determined by the prevailing load on the elevator car, as is illustrated at (b) in FIG. 5.

Consequently, the actual speed EP of the elevator car tends to be increased in correspondence to the motoring torque TM as generated. However, increasing in the motoring torque slightly beyond the level designated by the speed command signal ES will be suppressed by the braking torque generated through the brake control means, resulting eventually in that the rate of decreasing in the braking torque TB is lowered by a magnitude of the generated motoring torque TM, so that the overall torque TMB of the induction motor IM undergoes variation such as illustrated at (d). In this manner, the speed EP of the elevator car will follow the speed command signal ES with fidelity to become substantially zero at the landing point $t_5$ at which the electromagnetic brake 8 is actuated through detection of the zero speed or actuation of the reed switch 91*c*, whereby a smooth landing or stop of the car can be assured. In other words, the torque TT acting on the elevator car CA and rate of change in speed or acceleration/deceleration AD of the car CA are reduced smoothly, whereby the vibrations or fluctuations of deceleration/acceleration AD of the car CA can be suppressed to minimum at the time point $t_5$ at which the electromagnetic brake 8 is operated, as can be seen from the waveform (f) shown in FIG. 5.

The stopping or landing operation of the elevator car which is under a light load, in particular when there is such a free-run characteristics along the straight line $D_2$ will suffer from the drawbacks similar to those involved in the landing operation of the car under the heavy load described above, unless the load compensation is not adopted. More specifically, assuming that no load compensation is effected in the stopping operation of the car under the light load, the actual speed EP of the elevator car which tends to be decelerated with the free-run characteristics along the straight line $D_2$ is caused to follow the speed command signal ES through generation of a braking torque TB by a DC braking current $I_B$ at the time point $t_3$ at which deceleration of the elevator car is initiated, as is illustrated in FIG. 3. When the reed switch 91B is actuated at the time point $t_4$ as the car CA approaches to the destined stop or floor, deceleration commanded by the speed command signal ES is decreased so that the speed of the car CA may be substantially zero at the destined floor at the time point $t_5$.

In this connection, it should however be mentioned that the braking torque generated in the induction motor by the DC current is substantially in proportion to the revolution number of the induction motor in a range of a correspondingly low rotation speed. Accordingly, in a region close to a point corresponding to $t_5$, the speed deviation between the actual speed EP of the elevator car and the speed corresponding to the instant speed command signal ES will increase during the landing control.

Further, the brake control means should have a large gain and exhibit a rapid response in the deceleration control in order to attain an improved landing accuracy. However, an excessively large gain and rapid response will rather worsen the comfortable ride, unless the speed command is effected in a perfectly smooth manner. Since the gain and the response speed of the control system are selected in practice in consideration of the aforementioned condition, it is impractical to impart a large gain and rapid response to the brake control means only for the purpose of decreasing the speed deviation in the region close to the time point $t_5$.

Except for the range of small revolution number of the induction motor, a substantially constant torque can be produced independently from the revolution number of motor so far as the DC braking current is maintained constant. Accordingly, selection of the aforementioned constants (i.e. gain and response of the brake control means) is made in practice made in the constant torque range.

For the reasons described above, the speed EP of the car system as driven will not become zero at the time point $t_5$ but have a certain value or magnitude, as can be seen from the waveforms (a) and (f) as shown in FIG. 3. Consequently, when the speed of the elevator car is enforcively brought to zero through actuation of the electromagnetic brake 8, the elevator car CA will be subjected to appreciable vibrations, thereby deteriorating remarkably the comfortable ride, as described hereinbefore.

To evade the aforementioned undesirable situations, the load compensation can be effectively adopted in the landing or stopping control of the elevator car which is under the light load. In more particular, reference is to be made again to FIG. 4. When the elevator car slowing down with a substantially constant deceleration arrives at the position to actuate the reed switch 91B at the time point $t_4$, deceleration commanded by the speed command signal ES begins to be gradually decreased. At the same time, the portion b of the output signal $EL_2$ (FIG. 7B) produced from the compensation signal generating means 13 is supplied to the comparator 121 of the controller 12, as the result of which the braking torque TB produced by the DC brake current begins to be gently increased to a value compatible to the prevailing load on the elevator car. The decrease in the braking torque due to the lowering in gain of the brake control means in the low speed range of the induction motor can thus be compensated by increasing the DC brake current.

In this manner, the speed EP of the elevator car CA is caused to follow the speed command ES with an improved fidelity and attains substantially zero speed at the landing point $t_5$. Through the detection of the zero speed or alternatively actuation of the reed switch 91C, the electromagnetic brake 8 is operated to thereby assure a smooth landing or stopping of the car CA accurately at the level of the destined floor.

As will be appreciated from the above elucidation, the torque acting on the elevator car CA and hence acceleration/deceleration AD thereof can be decreased smoothly through the load compensation, whereby the possible fluctuation of acceleration/deceleration AD at the time point $t_5$ when the electromagnetic brake 8 is operated can be suppressed to minimum. The landing accuracy of the elevator car under the light load can thus be significantly improved with the comfortable ride being also improved.

Figure 6A:
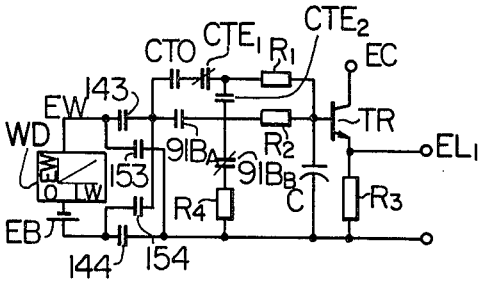
FIG. 6A is a circuit diagram showing an exemplary embodiment of load compensation signal generating means for heavy load operation.
Figure 6B:
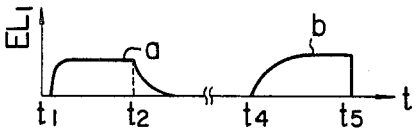
FIG. 6B is a waveform diagram to illustrate the waveform of the output signal produced from the load compensation signal generating means shown in FIG. 6A.

FIG. 6A shows in a circuit diagram a preferred embodiment of load compensation signal generating means for a heavy load operation included in the correction or compensation signal generating means 13 of FIG. 1 and FIG. 6B graphically illustrates the output signal $EL_1$ from the load compensation signal means of FIG. 6A as a function of time. The load detector WD produces an output voltage EW of a magnitude which is substantially proportional to a load LW on the elevator car CA. Reference numerals 143 and 144 denote up-contactors which are turned on only when the elevator car is moved in the upward direction, while down-contactors denoted by 153 and 154 are turned on only when the elevator car is operated in the downward direction. When a first relay (not shown) is electrically energized at the starting time point $t_1$ to thereby close a make contact CTO thereof, a voltage applied across a capacitor C rises up through charging by way of the up-contactors 143 and 144 (or the down-contactors 153 and 154), a break contact $CTE_1$ of a second relay which is not yet energized and a resistor $R_1$ from a DC power supply source EB. As the consequence, the output voltage $EL_1$ produced from an emitter-follower circuit composed of a DC power supply source EC, a transistor TR and a resistor $R_3$ rises in proportion to the voltage appearing across the capacitor C. The maximum value of the voltage $EL_1$ is substantially proportional to the load LW.

When the second relay (not shown) is energized at the time point $t_2$, the break contact $CTE_1$ thereof is opened with a make contact $CTE_2$ thereof closed. Consequently, the capacitor C is discharged through a circuit composed of the resistor $R_1$, the make contact $CTE_2$, a break contact 91BB of a third relay (not shown) which is not yet energized and a resistor $R_4$, whereby the output voltage $EL_1$ is decreased.

At the time point $t_4$, the position detector (or reed relay) described hereinbefore is actuated, whereby the third relay is electrically energized to close a make contact 91BA thereof. At the same time, the break contact 91BB of the third relay is opened to break the discharging circuit. Accordingly, the capacitor C is again charged through the closed circuit of the DC power supply source EB, the load detector WD, the up-contactors 143 and 144 (or down-contactors 153 and 154), resistor $R_2$ and the capacitor C. Thus, the output voltage $EL_1$ rises again progressively.

The bias voltage supplied from the DC power source EB is used for adjusting magnitude of the load signal $EL_1$. More particularly, when $EW-EB>0$, the output voltage $EL_1$ ($\approx EW-EB$) is produced through the circuit operation described above. On the other hand, the output signal $EL_1$ will not be produced, when $EW-EB\leqq 0$.

If the relay contactors 143 and 144 are closed in the upward operation of the elevator car and alternatively the relay contactors 153 and 154 are closed in the downward operation, as described above, and if the bias voltage EB is so set that $EW-EB=0$ at 50% of load, the desired signal for the load compensations as described hereinbefore can be obtained either in the upward or the downward operation of the elevator car.

Further, the load compensation control can be effected only in the heavy-load condition of the elevator car by changing over the polarity of the DC bias voltage EB between the upward and the downward operations and setting EB such that $EL_1=0$ under the 50%-load in approximation.

Figure 7A:
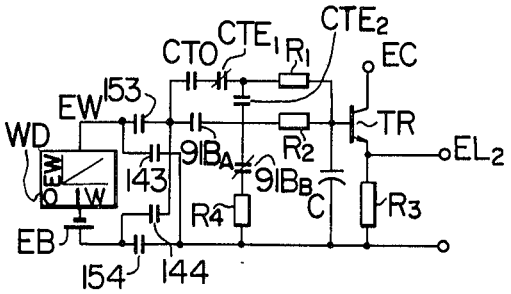
FIG. 7A is a circuit diagram showing an examplary embodiment of load compensation signal generating means for light load operation.
Figure 7B:
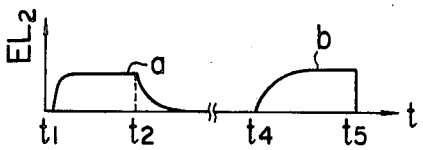
FIG. 7B is a waveform diagram to illustrate the waveform of the output signal produced from the load compensation signal generating means shown in FIG. 7A.

FIG. 7A shows in a circuit diagram a preferred embodiment of load compensation signal generating means for a light load operation included in the correction or compensation signal generating means 13 of FIG. 1 and FIG. 7B graphically illustrates the output signal $EL_2$ from the load compensation signal generating means of FIG. 7A as a function of time. As can be seen from these drawings, the construction of the load compensation signal generating means of FIG. 7A is quite the same as that of the load compensation signal generating means of FIG. 6A except for the fact that the locations of the up-contactors 143, 144 are exchanged with those of the down-contactors 153, 154 respectively and that the load compensation signal $EL_2$ as shown in FIG. 7B is produced from the circuit of FIG. 7A. Accordingly, the function of the circuit of FIG. 7A will be self-explanatory.

Figure 8:
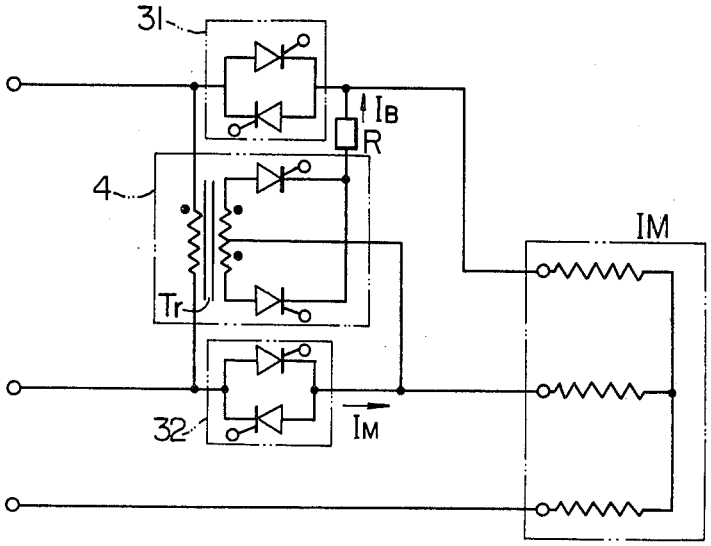
FIG. 8 shows a version of a drive circuit for the elevator car according to another embodiment of the invention.

FIG. 8 shows a modification of the main circuit portion shown in FIG. 1 which is adapted to energize an induction motor IM of a single winding type. Although a pair of thyristors 31 and 32 connected in anti-parallel configuration are used for the voltage control circuit 3 in a manner similar to the one shown in FIG. 1, the controlled rectifier circuit 4 is constituted by a full-wave rectifier circuit composed of paired thyristors through an isolating transformer Tr. The single winding of the induction motor IM is supplied with a DC current $I_B$ through a resistor R for protecting the power supply source from being short-circuited. With the circuit arrangement shown in FIG. 8, the teaching of the invention can be realized through combination with the control system of the same arrangement as the one shown in FIG. 1.

Although it has been described that the primary current control circuit including anti-parallel connection of thyristors is used for the motoring torque adjusting circuit, it will be appreciated that the invention is never restricted to such a circuit configuration. Any other circuit may be employed so far as the motoring torque can be continuously adjusted.

Further, although DC braking torque is utilized as the braking torque, it goes without saying that various types of the braking torque controls may be adopted such as an antiphase braking torque control in which the contactors 141; 142 and 151; 152 are mutually changed over to control the thyristors 3 in anti-parallel connection, for example.

It will be noted that the embodiments of the invention described in the foregoing brings about an additional advantage that the system can be implemented with an extremely small number of elements or components to be added, because the load compensation signal generating means for performing the load compensation at the starting of the elevator car is adapted to serve also for the landing or stopping control.

What is claimed is:

1. A control system for an AC elevator system driven from an AC power supply source, comprising:

induction motor means for driving an elevator;

means for detecting actual speed of said elevator;

means for detecting position of said elevator;

means for producing a speed command in response to said position detecting means, said speed command being so composed as to accelerate said elevator with a predetermined acceleration in starting operation and decrease gradually deceleration of said elevator in a stopping operation thereof as said elevator approaches to a target landing position;

means for comparing said actual speed with said speed command to thereby produce a speed deviation of said actual speed from said speed command;

braking torque control means for responding to said comparing means to actuate said induction motor means to generate a braking torque in accordance with said speed deviation when said actual speed is higher than said speed command; and additional torque generating means for actuating said induction motor means to generate additionally a torque in dependence on a load of said elevator in a region in the vicinity of said target landing position.

2. A control system for an AC elevator system according to claim 1, further including motoring torque contol means for responding to said comparing means to actuate said induction motor means to generate a motoring torque in accordance with said speed deviation when said actual speed is lower than said speed command, said motoring torque control means being adapted to respond to an output signal from said additional torque generating means to thereby actuate said induction motor means to generate additionally a motoring torque.

3. A control system for an AC elevator system according to claim 1, wherein said braking torque control means is adapted to respond to an output signal from said additional torque generating means to thereby actuate said induction motor means to generate additionally a braking torque.

4. A control system for an AC elevator system according to claim 2, wherein said braking torque control means is adapted to respond to an output signal from said additional torque generating means to thereby actuate said induction motor means to generate additionally a braking torque.

5. A control system for an AC elevator system according to claim 1, wherein said additional torque generating means is further adapted to cause said induction motor means to generate a torque in dependence on the load of said elevator in the starting operation of the elevator at least until the speed deviation of said actual speed from said speed command has attained a predetermined value.

6. A control system for an AC elevator system according to claim 5, further including motoring torque control means for responding to said comparing means to cause said induction motor means to generate a motoring torque in accordance with said speed deviation when said actual speed is lower than said speed command, said motoring torque control means being adapted to respond to an output signal from said additional torque generating means to thereby cause said induction motor means to generate additionally a motoring torque in said induction motor means.

7. A control system for an AC elevator system according to claim 5, wherein said braking torque control means is adapted to respond to an output signal from said additional torque generating means to thereby cause said induction motor means to generate additionally a braking torque.

8. A control system for an AC elevator system according to claim 7, wherein said braking torque control means is adapted to respond to an output signal from said additional torque generating means to thereby cause said induction motor means to generate additionally a braking torque.

9. A control system for an AC elevator system according to claim 1, 2, 3, 4, 5, 6, 7 or 8, wherein said induction motor means includes an induction motor having a winding for generating the motoring torque and a winding for generating the braking torque.

10. A control system for an AC elevator system according to claim 1, 2, 3, 4, 5, 6, 7 or 8, wherein said induction motor means includes two separate induction motors having different numbers of poles, said separate induction motors being mechanically coupled to each other, and wherein the induction motor having a small number of poles serves for generating the motoring torque, while the induction motor having a large number of poles serves for generating the braking torque.

11. A control system for an AC elevator system, comprising:

an induction motor system including first means for generating a motoring torque, second means for generating a braking torque and an output shaft;

an AC power supply source;

first thyristor means connected between said AC power supply source and said first means;

second thyristor means connected between said AC power supply source and said second means;

means for detecting position of the elevator;

means for detecting actual speed of the elevator;

speed command generating means for responding to said position detecting means to thereby produce a speed command which is so composed as to accelerate the elevator with a predetermined acceleration in the starting operation of the elevator and decrease gradually deceleration of said elevator in the stopping operation thereof as said elevator approaches to a target landing position;

first comparing means for responding to said speed detecting means and said speed command generating means to compare said actual speed with said speed command to thereby produce an output signal when said actual speed is lower than said speed command;

second comparing means for responding to said speed detecting means and said speed command generating means to compare said actual speed with said speed command to thereby produce an output signal when said actual speed is higher than said speed command;

means for responding to the output signal from said first comparing means to actuate said first thyristor means so as to energize said first means for generating the motoring torque;

means for responding to the output signal from said second comparing means to actuate said second thyristor means so as to energize said second means for producing the braking torque;

load detecting means for detecting a load within a car of the elevator; and means for responding to said load detecting means and said speed detecting means to produce selectively one of first and second correction signals in dependence on said load after deceleration of said elevator having been gradually decreased in the stopping operation, wherein said first and said second correction signals are applied to inputs of said first and second comparing means, respectively, in such a polarity that the resultant motoring torque is increased in response to an output signal from said respective first and second comparing means.

12. A control system for an AC elevator system according to claim 11, wherein said correction signal generating means is further adapted to produce selectively one of third and fourth correction signals in dependence on said load at least until deviation between said actual speed and said speed command has attained predetermined magnitude in the starting operation of the elevator, and wherein said third and fourth correction signals are applied to inputs of said first and second comparing means, respectively, in such a polarity that the resultant motoring torque is increased in response to an output signal from said respective first and second comparing means.

13. A control system for an AC elevator system, comprising:

a three-phase induction motor for driving the elevator;

a three-phase AC power supply source;

first thyristor means for connecting said AC power supply source to said induction motor to thereby generate a motoring torque in said induction motor;

second thyristor means for connecting said AC power supply source to said induction motor to thereby generate a braking torque in said induction motor;

means for detecting position of the elevator;

means for detecting actual speed of the elevator;

speed command generating means for responding to said position detecting means to thereby produce a speed command which is so composed as to accelerate the elevator with a predetermined acceleration in the starting operation of the elevator and decrease gradually deceleration of said elevator in the stopping operation thereof as said elevator approaches to a target landing position;

first comparing means for responding to said speed detecting means and said speed command generating means to compare said actual speed with said speed command to thereby produce an output signal when said actual speed is lower than said speed command;

second comparing means for responding to said speed detecting means and said speed command generating means to compare said actual speed with said speed command to thereby produce an output signal when said actual speed is higher than said speed command;

means for responding to the output signal from said first comparing means to actuate said first thyristor means so as to energize said induction motor to generate the motoring torque;

means for responding to the output signal from said second comparing means to actuate said second thyristor means so as to energize said induction motor to generate the braking torque;

load detecting means for detecting a load within a car of the elevator; and means for responding to said load detecting means and said speed detecting means to produce selectively one of first and second correction signals in dependence on said load after deceleration of said elevator having been gradually decreased in the stopping operation, said first and said second correction signals being applied to inputs of said first and second comparing means, respectively, in such a polarity that the resultant motoring torque is increased in response to an output signal from said respective first and second comparing means.

14. A control system for an AC elevator system according to claim 13, wherein said correction signal generating means is further adapted to produce selectively one of third and fourth correction signals in dependence on said load at least until deviation between said actual speed and said speed command has attained a predetermined magnitude in the starting operation of the elevator, and wherein said third and fourth correction signals are applied to inputs of said first and second comparing means, respectively, in such a polarity that the resultant motoring torque is increased in response to an output signal from said respective first and second comparing means.

* * * * *